US005556325A

United States Patent [19]

Shank, Jr.

[11] Patent Number: 5,556,325

[45] Date of Patent: Sep. 17, 1996

[54] PRESSURIZATION SYSTEM FOR ABRASIVE SUPPLY POT

[75] Inventor: James D. Shank, Jr., Vestal, N.Y.

[73] Assignee: Church & Dwight Co., Inc., Princeton, N.J.

[21] Appl. No.: 490,591

[22] Filed: Jun. 15, 1995

[51] Int. Cl.[6] ..... B24C 7/00

[52] U.S. Cl. ..... 451/101; 451/91; 451/99; 451/101; 451/100

[58] Field of Search ..... 451/91, 99, 100, 451/101

[56] References Cited

U.S. PATENT DOCUMENTS 5,081,799 1/1992 Kirschner et al. ..... 451/99
5,401,205 3/1995 Shank, Jr. ..... 451/101
5,421,767 6/1995 Spears, Jr. et al. ..... 451/101
5,431,594 7/1995 Shank ..... 451/101
5,433,653 7/1995 Friess ..... 451/101

*Primary Examiner*—D. S. Meislin
*Assistant Examiner*—George Nguyen
*Attorney, Agent, or Firm*—Irving M. Fishman

[57] ABSTRACT

A novel supply pot for holding a particulate abrasive is provided which greatly reduces the amount of moisture which is contained therein during pressurization. The supply pot includes a compressed air piping which directs compressed air from a source of compressed air to an inlet piping to the supply pot and to a downstream inlet to a blast hose, the compressed air piping comprising a moisture diverter which directs the compressed air from the piping to the blast hose initially bypassing the inlet to the supply pot, the diverter allowing backflow of compressed air from the outlet thereof to the inlet to the supply pot.

24 Claims, 3 Drawing Sheets

10
36
116
98
39
37
12
22
26
78
74
76
106
102
101
CLOSE
OPEN
OPEN
96
81
84
92
208
86
91
80
104
PG
D PG
PG
PG
88
90
94
82
LOW
HIGH
73
FILTER
3
AIR SUPPLY
2
WATER SUPPLY
100

PRESSURIZATION SYSTEM FOR ABRASIVE SUPPLY POT

FIELD OF THE INVENTION

The present invention is concerned with an abrasive supply pot, in general, and, particularly, to an improved pressurization system which reduces the amount of moisture which enters a supply pot containing a particulate abrasive material.

BACKGROUND OF THE INVENTION

Standard sand blasting equipment consists of a pressure vessel or supply pot to hold particles of a blasting medium such as sand, a source of compressed air connected to the supply pot via a conveying hose and a means of metering the blasting medium from the supply pot, which operates at a pressure that is the same or slightly higher than the conveying hose pressure. The sand/compressed air mixture is transported to a nozzle where the sand particles are accelerated and directed toward a workpiece. Flow rates of the sand or other blast media are determined by the type of media and coating being removed. Commercially available sand blasting apparatus typically employ media flow rates of 10–20 pounds per minute. About 0.5 to 1 pound of sand are used typically with about 1.0 pound of air, thus yielding a ratio of 0.5 to 1.0.

When it is required to remove coatings such as paint or to clean relatively soft surfaces such as aluminum, magnesium, plastic composites and the like, or to avoid surface alteration of even hard materials such as stainless steel, less aggressive abrasives, including inorganic salts such as sodium chloride and sodium bicarbonate, can be used in place of sand in conventional sand blasting equipment. The media flow rate used for the less aggressive abrasives is substantially less than that used for sand, and has been determined to be from about 0.5 to about 10.0 pounds per minute, using similar equipment. The lower flow rates require a much lower media to air ratio, in the range of about 0.05 to 0.5.

However, difficulties are encountered in maintaining continuous flow of less aggressive abrasive media at the lower flow rates when conventional sand blasting equipment is employed. The fine particles of abrasive media such as sodium bicarbonate are difficult to convey by pneumatic systems by their very nature. Further, the bicarbonate media particles tend to agglomerate upon exposure to a moisture-containing atmosphere, as is typical of the compressed air used in sand blasting. Flow aids such as hydrophobic silica have been added to the bicarbonate in an effort to improve the flow, but maintaining a substantially uniform flow of bicarbonate material to the blast nozzle has been difficult to achieve. Non-uniform flow of the blast media leads to erratic performance, which in turn results in increased cleaning time and even to damage of somewhat delicate surfaces.

Commonly assigned U.S. Pat. Nos. 5,081,799 and 5,083,402 disclose a modification of conventional blasting apparatus by providing a separate source of line air to the supply pot through a pressure regulator to provide a greater pressure in the supply pot than is provided to the conveying hose. This differential pressure is maintained by an orifice having a predetermined area and situated between the supply pot and the conveying hose. The orifice provides an exit for the blast media and a relatively small quantity of air from the supply pot to the conveying hose, and ultimately to the nozzle and finally the workpiece. The differential air pressure, typically operating between 1.0 and 5.0 psi with an orifice having an appropriate area, yields acceptable media flow rates in a controlled manner. The entire contents of U.S. Pat. Nos. 5,081,799 and 5,083,402 are herein incorporated by reference.

A media metering and dispensing valve which meters and dispenses the abrasive from the supply pot through the orifice and to the conveying hose carrying the compressed air stream typically operates automatically whenever the compressed air is applied to the blast hose to begin the abrasive blasting operation. The media valve for use in the afore-mentioned metering and dispensing process as disclosed in U.S. Pat. Nos. 5,081,799 and 5,083,402 is characterized as a Thompson valve and is described in general in U.S. Pat. No. 3,476,440, the contents of which are herein incorporated by reference. The Thompson valve includes a metering valve stem which blocks the outlet of a discharge tube disposed between the supply pot and an air flow tube which is secured to and carries the compressed air to the conveying hose. When the blast nozzle is activated, the valve stem is lifted from the valve seat of the Thompson valve and allows a controlled amount of media to flow through the outlet of the discharge tube into the air flow tube. The valve as disclosed in U.S. Pat. No. 3,476,440 has been improved by placing the valve stem within a control sleeve which contains a plurality of orifices having different sizes, one of which can be placed in communication with the outlet of the discharge tube and the air flow tube by rotation of the media sleeve. When the valve stem is placed wholly within the control sleeve and closed, the orifice in the control sleeve is blocked such that media cannot flow from the discharge tube through the orifice in the media control sleeve and then into air flow tube. Upon operation of the blast nozzle, the valve stem is lifted through the sleeve and pulled away from the orifice to allow the media to flow from the pot to the discharge tube, through the orifice and into the air flow tube. The improved valve is described in commonly assigned U.S. Pat. No. 5,421,767, issued Jun. 6, 1995, and U.S. Pat. No. 5,401,205, issued Mar. 28, 1995, the contents of both of which are herein incorporated by reference.

As briefly discussed above, moisture is often added to the media in the supply pot during pressurization. Pressurization is provided from a supply of compressed gas (air) and pressure regulated to a piping T-connector which directs the compressed air through separate piping to the supply pot and the blast hose and nozzle. During pressurization of the supply pot, compressed air enters the media supply pot through a pop-up tube after the abrasive media has been fully loaded into the pot. Incoming air causes a pop-up valve slidably engaged in the pop-up tube to rise and seal off the media supply opening in the pot allowing pressurization of the pot and activation of the differential pressure media metering system described previously. Unfortunately, moisture accumulates in the air supply line to the supply pot and upon the initial pressurization of the media supply pot, the compressed air carries the collected pool of moisture up the pop-up tube and into the media pot moistening the media and causing portions of the particulate media to agglomerate. Still further, the compressed air itself may contain moisture in the form of fine droplets which are carried to the abrasive particles in the pot. The agglomerated media is not readily free-flowing which often causes a non-uniform media flow from the pot. The problem of moisture is exacerbated since the initial air expands rapidly causing the air to cool which consequently causes precipitation of the trapped moisture from the air onto the particulate media.

It would be worthwhile to provide a means to supply compressed air to the media supply pot for the differential pressure metering system which supply means would eliminate the problem of entrained moisture within the compressed air from leaving the pop-up tube and falling onto the particulate abrasive media in the supply pot.

In commonly assigned, copending application U.S. Ser. No. 161,528, filed Dec. 6, 1993, the substantial elimination of entrained moisture from precipitating onto the abrasive particles in the supply pot is achieved by providing a novel pop-up valve in the abrasive media supply pot. As disclosed therein the pop-up valve includes a pop-up valve stem which fits and is slidable within a pop-up valve tube which is secured to the compressed air supply tube. The pop-up valve tube includes an insert which prevents air and accumulated moisture from passing between the circumferential edge of the pop-up valve tube and the pop-up valve stem. Moisture which contacts the insert falls back into the compressed air supply line which can be periodically drained. The insert in the pop-up valve tube includes a central orifice which limits the expansion of the compressed air entering the pot to reduce cooling of the expanding gas and prevent precipitation of entrapped moisture. The entire contents of U.S. Ser. No. 161,528 is herein incorporated by reference.

Further, it would be most useful to prevent moisture present in the compressed air line from even entering the supply pot.

SUMMARY OF THE INVENTION

In accordance with the present invention, improvements are made to the supply pot which holds the abrasive so as to reduce the amount of moisture which enters the supply pot. Accordingly, the piping which directs compressed air from the supply thereof to the supply pot to pressurize same and simultaneously to the blast hose and nozzle apparatus is provided with a moisture diverter which carries moisture droplets contained in the compressed air past the piping inlet to the supply pot and directs such moisture laden air to the blast hose and nozzle apparatus. Back flow of drier, compressed air from the diverter into the piping inlet to the supply pot is provided to allow for pressurization of the supply pot without adding moisture which can disadvantageously cause agglomeration and reduced flow of the abrasive, in particular, less aggressive abrasives such as water soluble salts including sodium bicarbonate. The moisture diverter of the invention is preferably used in combination with the novel pop-up valve described in commonly assigned U.S. Ser. No. 161,528.

DETAILED DESCRIPTION OF THE INVENTION

The invention can best be described by referring first to the preferred method of controlling the metering of the abrasive media into the compressed air stream using differential pressure as disclosed in U.S. Pat. No. 5,083,402. The differential pressure metering system has been found to accurately and uniformly control the flow of less aggressive abrasive media such as sodium bicarbonate. The supply pot of this invention is particularly useful since the amount of moisture which contacts the media in the pot is greatly reduced. In order to feed fine particles of a material such as a bicarbonate abrasive having a mean particle size of from 50 to 1000 microns, preferably from about 200 to 300 microns, at a uniform rate, pressures within the supply pot, including the blast hose pressure, must be positive with respect to the nozzle. Pressures are typically in the range of about 10–150 psig.

Since the supply pot and the conveying hose operate at about the same pressure, the flow of blast media in conventional sand blasting equipment is controlled by gravity feed and a metering valve. It has been found, however, that the supply pot was under a small differential pressure with respect to the blast delivery hose pressure, which fluctuated between positive and negative. The result was that the flow rates of the blast media fluctuated also in response to the differential pressure changes. Accordingly, a differential pressure gauge has been installed between the delivery hose and the supply pot to monitor the differential pressure directly. The pressure can be closely controlled by means of a pressure regulator at any hose pressure from 10 to 125 psig or higher, depending on the supply air pressure. The invention disclosed in U.S. Pat. No. 5,083,402 eliminates the source of flow rate variation and also modifies conventional equipment to handle blast media at low flow rates of from about 0.5 to 10 pounds per minute, preferably up to about 5 pounds per minute.

Figure 1:
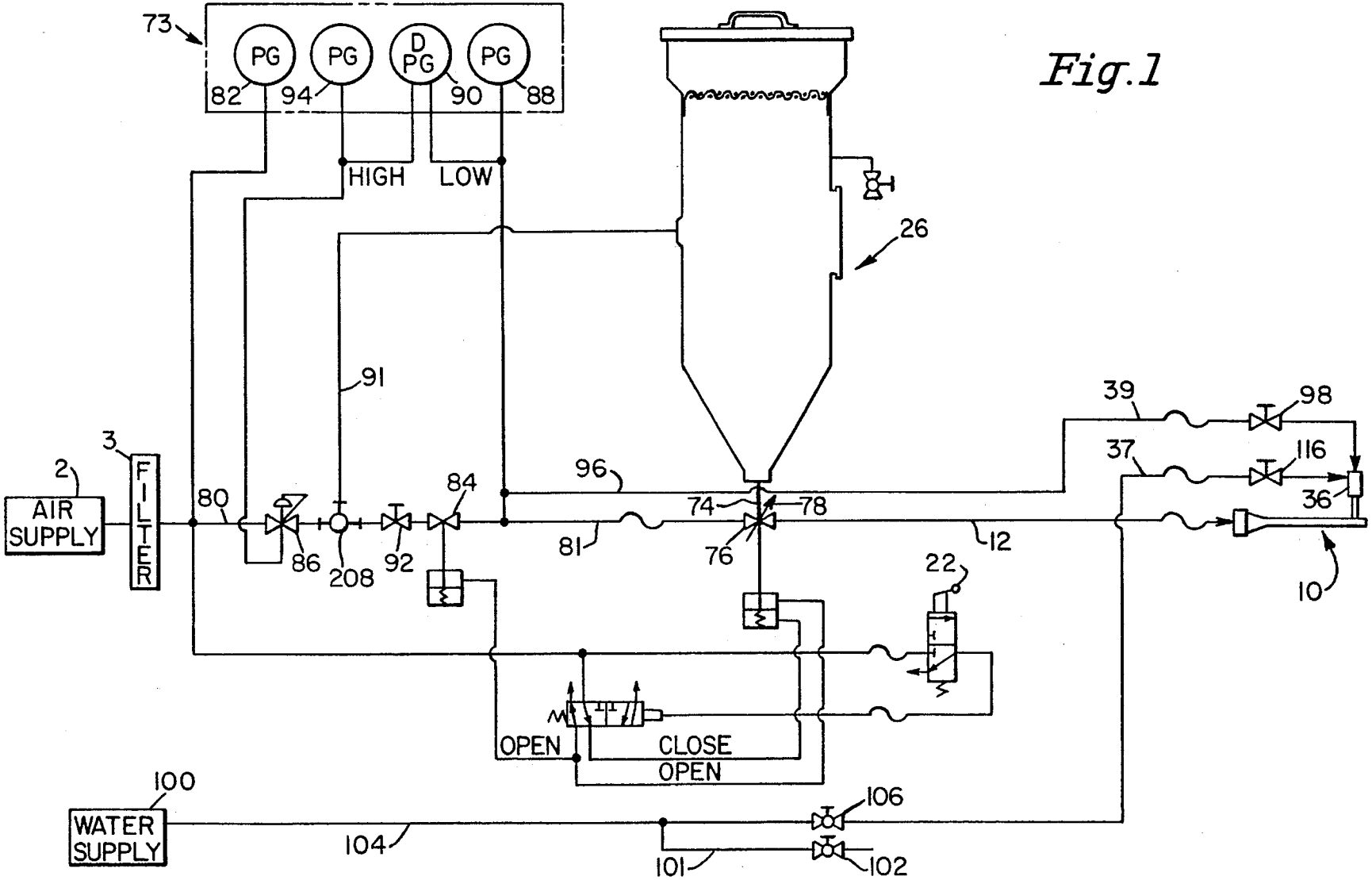
FIG. 1 is a schematic illustration of the differential pressure metering system useful with less aggressive abrasives and the supply pot of this invention.

The differential pressure metering system can be described by reference to FIG. 1. The differential pressure metering system shown in FIG. 1 operates on the same principle as disclosed in U.S. Pat. No. 5,083,402 but has been modified slightly therefrom. Although the blast media illustrated is sodium bicarbonate, other blast media such as potassium bicarbonate, ammonium bicarbonate, sodium chloride, sodium sulfate and other water-soluble salts are meant to be included herein. Referring to FIG. 1, the blast system includes supply pot 26 partially filled with blast media 24. The supply pot 26 suitably having a cavity of about 1 to 10 cubic feet, terminates in a media exit line 74 governed by a media control valve 76. The media control area can be further limited by an orifice represented by arrow 78 which further restricts the flow of the media 24 to the desired flow rate. Such orifice is preferably part of media valve 76 as disclosed in aforementioned U.S. Pat. No. 5,421,767. A line 80 is connected to a source 2 of pressurized air which is filtered via filter 3. Pressurized air from line 80 is split between line 81 which feeds supply hose 12 and nozzle 10 and line 91 which feeds supply pot 26. Air valve 84 is a remotely operated on/off valve that activates the air flow to blast nozzle 10 and the opening and closing of the media control valve 76. Blast pressure regulator valve 86 regulates the pressure in line 91 to supply pot 26. Adjustment valve 92 regulates the pressure in line 81 to media control valve 76 and blast pressure in nozzle 10. Adjustments in air pressure made by valve 92 controls media flow through valve 76 and thus from pot 26 into line 12.

Line pressure in the metering system useful in this invention can be continually monitored and visualized by the operator. In this regard, the differential pressure metering system includes a gauge manifold 73 which includes a pressure gauge 82 to measure the inlet pressure from supply 2 through line 80, a pressure gauge 94 to measure the line pressure from regulator valve 86 and in line 91, and a pressure gauge 88 which measures the line pressure in line 81 directed to the media control valve 76 and the blast hose line 12. Differential pressure gauge 90 monitors the pressure between line 91 to the supply pot 26 and line 81 to media valve 76 and the supply hose 12. The regulator valve 86 provides a pressure in line 91 measured by gauge 94 higher than the pressure in line 81 provided by adjustment valve 92 and measured by gauge 88, thus providing the differential pressure monitored by differential pressure gauge 90 and required to control media flow.

In operation, the blast media 24 is fed through media exit line 74 governed by the media control valve 76 to an orifice 78, which further regulates the flow of media to the compressed air line 81. The orifice openings can vary from about 1/16 to about 1/4 inch diameter, or openings corresponding to the area provided by circular orifices of 1/16 to 1/4 inch diameter. Preferably, the openings correspond to about a 0.125 inch opening for sodium bicarbonate media having a mean particle size of about 70 microns, and 0.156 inch opening for a media having a mean particle size from about 250 to about 300 microns. A positive pressure of between about 1 to 5 psig preferably about 2 to 4 psig between the media exit line 74 and the conveying hose 12 is maintained at all times. A source of compressed air is fed to the air line 81, regulated by the valve 92 to the desired air pressure which preferably is between about 30 to about 150 psi. The pot pressure regulator 86 controls the pressure to the top of the supply pot 26, further ensuring a controlled and uniform flow of blast media 24. The manometer or other differential pressure gauge 90 measures the differential pressure, which is proportional to the amount of media flowing through the orifice 78. The blast media and compressed air are delivered to the nozzle 10 and ejected toward the workpiece at a uniform and controllable rate.

Optional equipment for protection of and cooling of the workpiece and, in particular, for the control of dust is provided by a water atomizer 36 which directs a spray of atomized water toward the work surface. A more detailed description of the water atomizer is disclosed in commonly assigned U.S. Pat. No. 5,319,894, issued Jun. 14, 1994, the contents of which are herein incorporated by reference. The operation of the water atomizer nozzle 36 is similar to that described for the blast nozzle 10 above. Thus, air typically from supply 2 which feeds blast nozzle 10 is directed through line 96 and the pressure thereof controlled by pressure regulator 98. Hose 39 directs the pressurized air to the appropriate air inlet port in the nozzle body of the water atomizer 36. Valve 84 is an on/off valve which controls all air pressure through lines 80, 81, 91 and 96 and is activated by a spring loaded deadman valve 22 which is controlled by the operator. Water for the water atomizer nozzle 36 is directed from a supply 100 and passed through line 104. The pressure is controlled by pressure regulator valves 106 and 116. Water through hose 37 is passed to a water inlet port of the nozzle body of water atomizer 36. Water pressure is controlled independent of deadman switch 22. A drain line 101 and valve 102 can be used to drain water from line 104 and hose 37.

Figure 4:
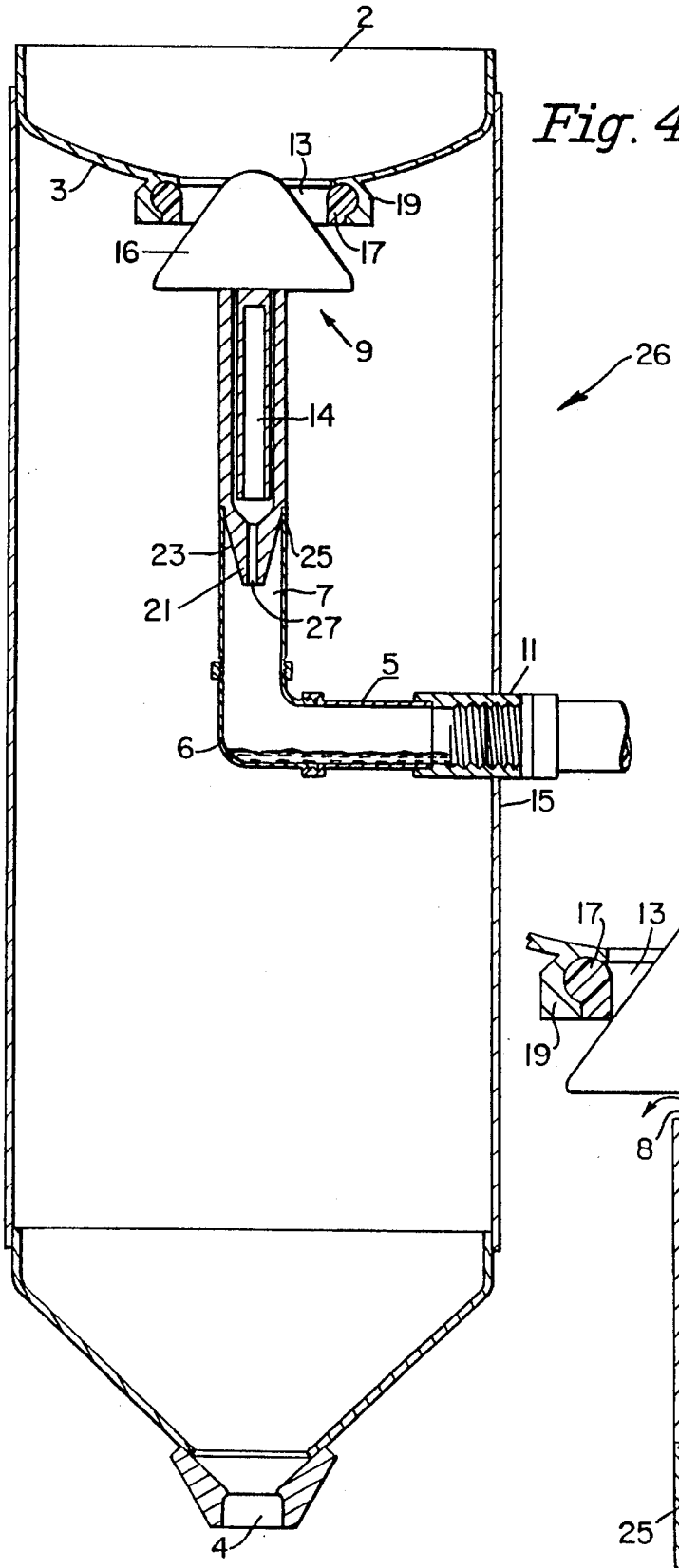
FIG. 4 is a cross-sectional view of a media supply pot useful in this invention and disclosed in before-mentioned U.S. Ser. No. 161,528.

In FIG. 4, reference numeral 26 designates generally the novel supply pot of this invention capable of holding an abrasive and dispensing same and, preferably, including the pop-up valve 9 disclosed in U.S. Ser. No. 161,528, mentioned previously. Supply pot 26 is adapted to be filled or partially filled, with, sodium bicarbonate, sand or other abrasive. Supply pot 26 can be adapted to be transported to the point of use, at which point the pot is pressurized and serves as the dispenser for the abrasive.

Supply pot 26 is made of steel or other suitable rigid material and is capable of being pressurized. Normally, the pot 26 is a pressure vessel made in accordance with the American Society for Mechanical Engineers Code. Pot 26 has a loading area 2 at the upper end thereof. A closure cap or cover (not shown) is optional and should be removably mounted therewith. Loading area 2 includes a downwardly sloping floor 3 secured to the inside surface of pot 26. Floor 3 slopes to a center inlet opening 13 whereby the abrasive media particles are dispensed from loading area 2 through opening 13 and into pot 26. Floor 3 acts as a lid for the interior of pot 26. A cover can be installed to prevent foreign matter or moisture from entering pot 26 through loading area 2.

A media discharge or outlet 4 is provided at the bottom of the pressure vessel or pot 26 for the discharge and metering of the bicarbonate or other abrasive from the pot 26 through a metering valve. Although not shown in FIG. 4, media outlet 4 has media control valve 76 mounted therewith when the differential pressure metering and control system is used as more fully explained in connection with FIG. 1. The bottom of pot 26 contains downwardly sloping sidewalls 28 and is of substantially conical shape, the apex of which contains discharge outlet 4.

When the pot 26 has been filled with abrasive, pot 26 may then be pressurized with air. To accomplish such pressurizing, a gas inlet pipe 11 is provided to extend through sidewall 15 of pot 26 and is welded thereto so that no air pressure escapes through sidewall 15 around pipe 11. Pipe 11 is connected to a source 2 of compressed air such as through piping 80 and 91 as shown in FIG. 1 and the compressed air stream regulated by means of pressure regulator 92. Within the interior of pot 26, a supply pipe 5 is secured to inlet pipe 11. In the center of pot 26, pipe 5 bends upward at elbow 6 and communicates with a valve tube 7 threaded onto elbow 6, and directed upwardly into pot 26.

Figure 5:
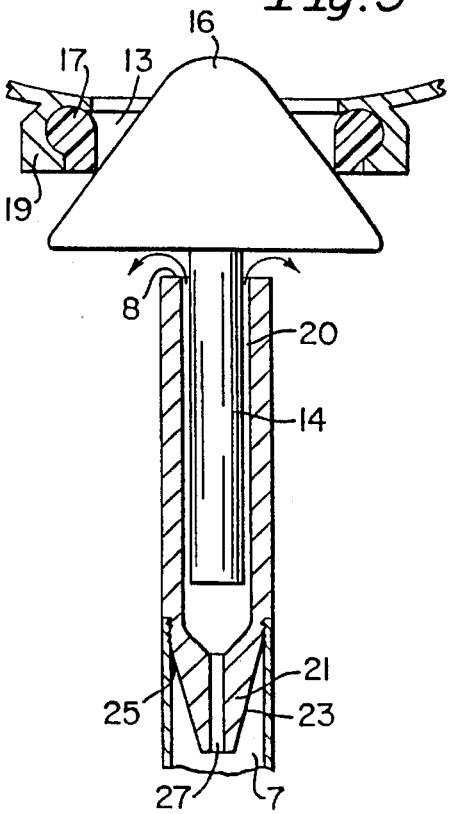
FIG. 5 is a cross-sectional view of the pop-up valve shown in FIG. 4 and placed in the open position to allow pressurization of the supply pot.

As shown in FIGS. 4 and 5, the upper end 8 of valve tube 7 is disposed near the upper end of pot 26 so that an air pressure is developed above the abrasive contained in pot 26. Slidable within valve tube 7 is pop-up valve 9 containing a valve stem 14 and a valve stopper 16 which can snugly fit within media inlet opening 13 so as to prevent the escape of air through opening 13. When compressed air is supplied to pipe 5, the air passes through valve tube 7 and against valve stem 14 which is slidable upwardly with valve stopper 16 to seal the media opening 13. Valve stopper 16 fits against valve gasket 17 which surrounds opening 13 and rests within gasket support 19. Gasket support 19 is secured to the underside of floor 3. Between the inside wall of valve tube 7 and the outside surface of valve stem 14 is a small annular space 20 approximately 1/8 inch wide through which the air escapes once pop-up valve 9 is unseated from the top 8 of valve tube 7.

Previously, moisture which had sat within pipe 5 was blown into the pot 26 through valve tube 7 by the compressed air. The moisture typically traveled along the circumferential edge of the valve tube 7 in view of the differing densities between the compressed air stream and water and the centrifugal forces caused by the compressed air travelling through pipe elbow 6. The rapid expansion of the air as it initially entered tank 26 caused the compressed air stream to cool resulting in precipitation of entrapped moisture into the pot 26 and onto the abrasive media particles. The moisture tended to agglomerate the abrasive particles and often resulted in non-uniform metering of the abrasive through the media outlet 4 and through the downstream media control valve.

In accordance with the invention described in U.S. Ser. No. 161,528, the valve tube 7 has been reconfigured to include a moisture trap so as to prevent moisture from entering pot 26 during the initial pressurization thereof and to prevent the precipitation of moisture which is entrapped in the compressed air stream which enters pot 26. Thus, as shown in FIGS. 4 and 5, the moisture trap comprises a downwardly tapering cone 21 which sits within valve tube 7 below valve stem 14 of pop-up valve 9. Cone 21 includes downwardly tapered side surface 23 which extends from a point of contact with the inside walls of valve tube 7 at location 25 to the downwardly pointing apex of cone 21. Thus, moisture which is entrained in the compressed air stream and traveling along the inside circumferential edge of valve tube 7 will be stopped at the location 25 where side surface 23 contacts the inside edge of valve tube 7 and such moisture will fall back down into pipe 5. The compressed air from pipe 5 and valve tube 7 enters pot 26 through a central narrow passage 27 extending from the apex of cone 21 completely therethrough and opening into valve tube 7 below the seated valve stem 14. By restricting the amount of air which is directed to pot 26 by imposition of cone 21, pressurization and expansion of air in supply pot 26 is slowed considerably. For example, fill time without the moisture trap is about 2 seconds while fill time through passage 27 is about 15–20 seconds. By slowing the expansion of air, the air is not so rapidly cooled and thus, entrapped moisture in the air is not readily precipitated into the pot and onto the abrasive. A drain (not shown) can be attached to inlet pipe 11 to remove entrapped moisture which accumulates in pipe 5. Preferably, the compressed air line 5 is a 1¼ inch supply pipe and the central passage 27 has a diameter of 3/16 of an inch. The annular space 20 between the valve stem 14 and pop-up tube 7 is approximately ⅛ of an inch to allow air flow into pot 26.

As seen in FIGS. 4 and 5, cone 21 and valve tube 7 can be separate components in which the cone 21 and the vertical side surfaces 22 thereof which enclose valve stem 14 are of integral construction which is threaded onto valve tube 7 at location 25. Alternatively, the valve tube 7 can be of integral construction with cone 21 and side surfaces 22.

The novel pop-up valve 9 has been found very effective in greatly reducing the amount of moisture which contacts the abrasive media which is stored within supply pot 26. However, the purpose of the valve tube 9 is to prevent moisture which has already entered supply piping 5 extending into supply pot 26 from contacting the abrasive media. The improvement of the present invention can be used with or without pop-up valve 9 as illustrated in FIGS. 4 and 5, although, it is preferred to use the moisture diverter of the present invention in combination with pop-up valve 9 to readily insure a dry abrasive media and prevention of the disadvantageous agglomeration and nonuniform flow of abrasive through the abrasive metering system. The moisture diverter of the present invention is for the purpose of greatly reducing the amount of moisture which enters supply pot 26.

Figure 2:
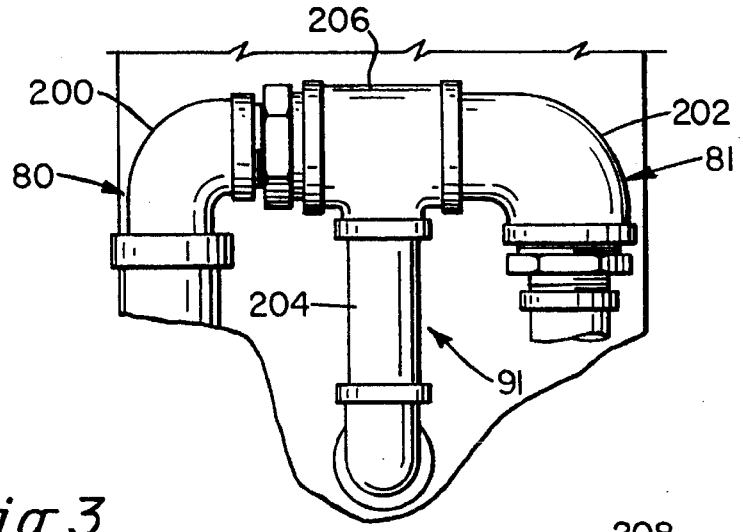
FIG. 2 is a fragmented elevational view of the compressed air piping for pressurizing the supply pot and the blast hose and nozzle apparatus.
Figure 3:
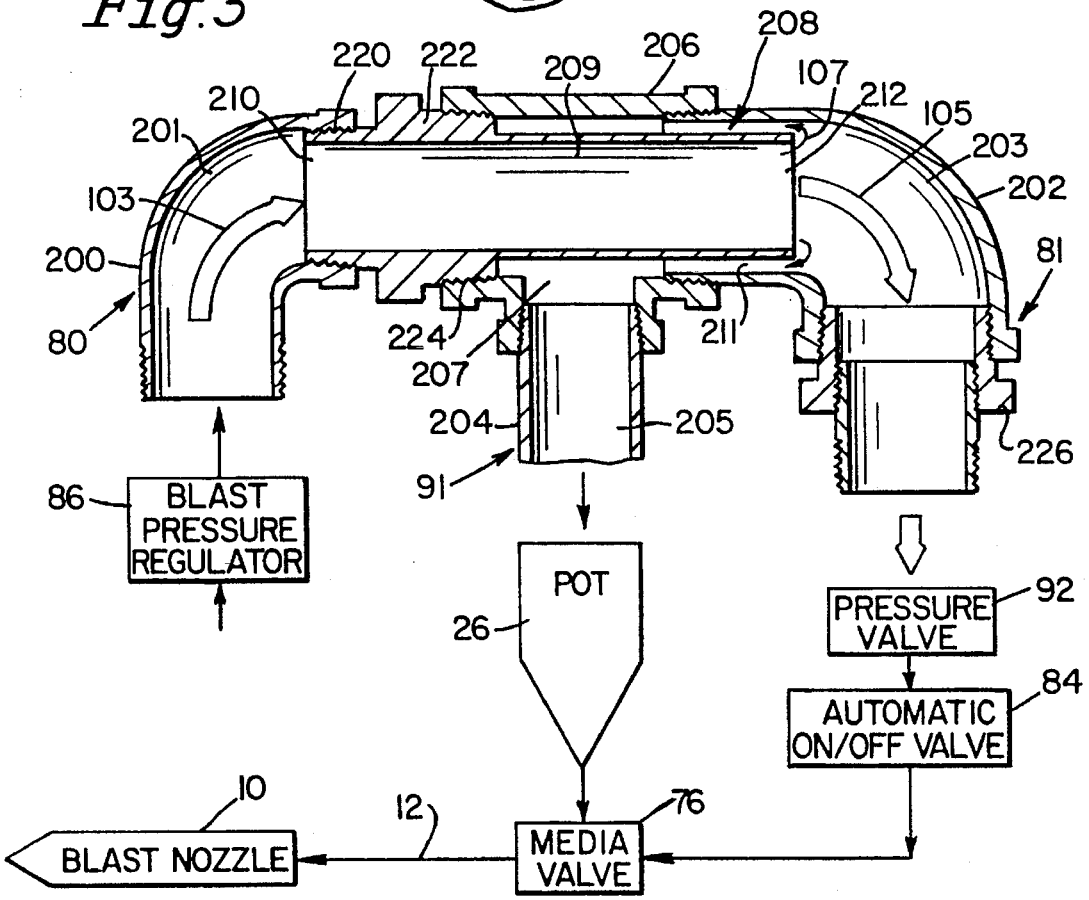
FIG. 3 is a cross-sectional view of the compressed air piping of FIG. 2 illustrating the moisture diverter of the present invention.

The moisture diverter of the present invention can best be described with respect to FIGS. 1, 2 and 3. As can be seen, air line 80 and piping 81 and 91 directed to the blast hose and nozzle apparatus and supply pot 26, respectively, are formed of pipes 200, 202 and 204, respectively. A T-connector 206 connects the respective individual pipes 200, 202 and 204 wherein pipe 204 which directs the compressed air to supply pot 26 is preferably, downwardly connected to the central stem portion of T-connector 206. Connecting the internal space 201 of pipe 200 with the internal space 203 of pipe 202 is moisture diverter 208 of the present invention. Moisture diverter 208 comprises a hollow cylindrical tube having an interior space 209, an inlet 210 which communicates with interior space 201 and outlet 212 which communicates with interior space 203. Moisture diverter 208 can be secured (threaded) onto pipe 200 and T-connector 206, as shown and as described in more detail below. Any other conventional means to secure moisture diverter 208 to the respective piping to achieve the objectives of this invention can be used.

As can be seen from FIGS. 1 and 3, the inlet to piping 81 (pipe 202) is downstream of the inlet to piping 91 (pipe 204) which directs the compressed air from source 2 and piping 80 to supply pot 26. Moisture diverter 208 is positioned to prevent compressed air passing through pipe 200 from being directly passed into T-connector 206 and pipe 204 leading to supply pot 26. Thus, inlet 210 of moisture diverter 208 is contiguous with pipe 200 and outlet 212 of moisture diverter 208 is contiguous with pipe 202 which is downstream of pipe 204. Accordingly, compressed air passing through pipe 200 and containing moisture droplets will pass through moisture diverter 208 and then into pipe 202 initially bypassing pipe 204. Outlet 212 of moisture diverter 208 has a smaller diameter than the diameter of pipe 202 and T-connector 206 such that there is an annular space 211 between the sidewall of moisture diverter 208 adjacent outlet 212 and the sidewalls of pipe 202 and T-connector 206. The annular space 211 is in communication with the internal space 207 of T-connector 206 and the internal space 205 of piping 204. Accordingly, compressed air will backflow from outlet 212 through annular space 211 and into piping 204 to pressurize the supply pot 26. The air which flows back through annular space 211 and into supply pot 26 via pipe 204 will be substantially drier than the compressed air stream passing through moisture diverter 208 since the momentum of the moisture droplets in the compressed air stream exiting outlet 212 of moisture diverter 208 will not allow for backflow into annular space 211. Instead, the moisture droplets will be carried through pipe 202 and will be directed to the blast hose and nozzle apparatus.

The presence of moisture in the supply hose or blast nozzle does not adversely affect abrasive media flow. Importantly, however, the moisture droplets contained in the compressed air stream from source 2 are diverted away from the supply pot 26, thus, maintaining a drier environment therein without resorting to inert gas pressurization. The moisture diverter 208 in combination with the pop-up valve 9 drastically reduces the moisture level in supply pot 26 and, accordingly, maintains the abrasive in a free-flowing state.

The specific structure for attaching moisture diverter 208 to the respective piping to divert the moisture laden air to the downstream outlet can vary and is not overly critical to the present invention except that the presence of the diverter 208 must achieve its intended purpose. It is preferred, however, to prevent backflow of the compressed air from entering inlet piping 80 (200). Thus, as shown in FIG. 3, moisture diverter 208 is a hollow tube having an open inlet end 210 and an open outlet end 212 and in which the inlet end 210 includes threads 220 on the exterior thereof which match with internal threads on pipe 200. Downstream from inlet 210, moisture diverter 208 includes an exterior circumferential boss 222 which includes external threads 224 which match with internal threads in the interior of T-connector 206. The connection of boss 222 to the interior surface of T-connector 206 prevents backflow of compressed air from entering pipe 200.

Preferably, T-connector 206 has a larger diameter than pipe 200 so that moisture diverter 208 can be of sufficient diameter to provide the necessary volume of compressed air flow to feed the blast hose and allow for a sufficient annular space 211 to pressurize the supply pot 26. Pipe coupling 226 can be secured to pipe 202 to again reduce the diameter of pipe 202 consistent with pipe 200. Again, other configurations of moisture diverter 208 can be readily determined to achieve the objects of the present invention and, accordingly, it is not intended that the scope of the appended claims be strictly limited to the specific structure shown.

Referring again to FIG. 3, the airflow through the blast system of the present invention is shown. Thus, inlet air from a compressed air source 2 is directed into piping 80 and the pressure thereof controlled through blast pressure regulator 86. Following arrow 103, the air is passed through pipe 200 and then into moisture diverter 208. Airflow from the outlet 212 of moisture diverter 208 via arrow 105 passes directly into the inlet of pipe 203 which carries the compressed air to piping 81 wherein the air pressure is adjusted by adjustment valve 92. Subsequently, the air flows through the on/off valve 84, media valve 76 to open up the abrasive flow from pot 26 into the airline 12 and then eventually into blast nozzle 10. Any moisture which is contained within the compressed air stream passes with the compressed air stream following arrow 105 due to the momentum of the heavier moisture droplets. There is a backflow of air via arrows 107 from the outlet 212 of moisture diverter 208 into the annular space 211 and into piping 91 and pipe 204 to pressurize supply pot 26. Abrasive from pot 26 feeds the media valve 76. As well, the differential pressure gauge 90 measures the differential pressure between the compressed air of the supply pot above orifice 78 (High) relative to the compressed air in conveying line 12 (Low) so as to monitor and eventually control the abrasive flow through orifice 78.

What is claimed is:

1. An abrasive blast system comprising:

a supply pot having an inlet for filling same with abrasive and an outlet for discharging abrasive therefrom, a blast hose and blast nozzle apparatus for receiving the discharged abrasive, a source of compressed air, piping communicating with (1) said source of compressed air, (2) a first inlet to said supply pot and (3) a second inlet to said blast hose and blast nozzle apparatus, said piping communicating with said first and second inlets downstream from said source of compressed air and with said second inlet downstream from said first inlet, diverter means in said piping to carry a compressed air stream in said piping from said source directly to said second inlet to said blast hose and blast nozzle apparatus thereby by-passing said first inlet to said supply pot, said diverter means allowing backflow of compressed air in said piping from said second inlet to said first inlet for said supply pot to pressurize said supply pot.

2. The blast system of claim 1 wherein said first inlet to said supply pot is a pipe, said second inlet to said blast hose and blast nozzle apparatus is a second pipe which communicates with said piping downstream of said first pipe.

3. The blast system of claim 2 wherein said diverter means comprises an inlet which communicates with said piping and an outlet which communicates directly with said second pipe, said backflow of compressed air being provided between an outer wall of said diverter means and an inner wall of said second pipe.

4. The blast system of claim 3 wherein said diverter means is an open ended hollow tube which has a smaller diameter than the diameter of said second pipe to provide an annular space for backflow of compressed air.

5. The blast system of claim 2 wherein said piping is separate from said first inlet pipe to said supply pot and said second inlet pipe to said blast hose, said piping communicating with said first inlet pipe to said supply pot and said second inlet pipe to said supply hose by means of a T-connector wherein said piping and said second inlet pipe to said blast hose are connected on opposite arms of said T-connector and said first inlet pipe to said supply pot is connected to the stem of said T-connector.

6. The blast system of claim 5 wherein said diverter means is an open-ended hollow member with a diverter means inlet communicating with said piping between said source of compressed air and said T-connector, said hollow member extending through said T-connector and containing a diverter means outlet which communicates with second inlet pipe to said blast hose downstream of said T-connector, said backflow of compressed air being provided in a space between said hollow member and interior side walls of said second inlet pipe to said blast hose and said T-connector.

7. The blast system of claim 6 wherein the stem of said T-connector and said first inlet pipe are positioned vertically.

8. The blast system of claim 6 wherein said diverter means is threaded onto said piping.

9. The blast system of claim 8 wherein said diverter means includes an exterior boss means to prevent backflow of compressed air into said piping.

10. The blast system of claim 9 wherein said diverter means is threaded onto said T-connector by means of threads contained on said boss means.

11. The blast system of claim 1 including a third inlet for directing compressed air from said first inlet into the interior of said pot, a vertically disposed valve tube communicating with said third inlet and containing an opening to the interior of said supply pot to allow pressurization of said pot, said valve tube comprising an insert placed therein and disposed between said third inlet and said opening, said insert contacting the interior side wall of said valve tube so as to prevent moisture from traveling up the side wall of said valve tube, through said opening and into said supply pot, said insert containing a passage therethrough communicating with said third inlet and said opening into said supply pot.

12. The blast system of claim 11 including a pop-up valve slidable within said valve tube and including a valve stopper at the top of said pop-up valve which can fit within said abrasive inlet to seal off said supply pot, said pop-up valve being slidable within said valve tube between said insert and said opening of said valve tube into said supply pot.

13. The blast system of claim 12 wherein said pop-up valve includes a valve stem slidable in said valve tube, said opening into said supply pot being an annular space located at the top of said valve tube between said pop-up valve stem and said valve tube.

14. The blast system of claim 11 wherein said abrasive outlet is at the bottom of said supply pot.

15. The blast system of claim 11 wherein said insert is a downwardly pointed cone placed within said valve tube, said passage in said insert initiating at the apex of said cone and being centrally disposed through said cone and in communication with the valve tube above said insert.

16. The blast system pot of claim 15 wherein the base of said cone is in contact with the interior sidewall of said valve tube.

17. The blast system of claim 13 wherein said pop-up valve stem is hollow.

18. The blast system of claim 12 including a gasket surrounding said abrasive inlet into said pot, said valve stopper being sealed within said gasket when said pop-up valve is slidable up said valve tube.

19. The blast system of claim 11 wherein said third inlet is a supply pipe passed horizontally through a sidewall of said pot, said supply pipe having an elbow which connects said horizontal supply pipe with said vertically disposed valve tube.

20. A moisture diverting apparatus to reduce the moisture level of a compressed air stream comprising a piping having an inlet communicating with a source of compressed air, a first outlet and a second outlet downstream of said first outlet, a diverter means having a diverter inlet in communication with the inlet of said piping and a diverter outlet which communicates directly with said second outlet, said diverter means providing backflow of compressed air from said diverter outlet into said first outlet whereby the compressed air which backflows into said first outlet is drier than the compressed air from said source.

21. The apparatus of claim 20 including means to prevent backflow of said compressed air from said diverter outlet to the inlet of said piping.

22. The apparatus of claim 21 wherein said first outlet is placed on the stem of a T-connector and said second outlet is placed on one arm of said T-connector, said piping being connected to the other arm of said T-connector wherein said diverter means passes through said T-connector and allows communication directly from said piping to said second outlet.

23. The apparatus of claim 22 wherein said diverter means comprises a hollow tubular member having a diameter which is less than the diameter of said T-connector and said second outlet.

24. The apparatus of claim 22 wherein said stem of the T-connector and said first outlet are positioned vertically.

* * * * *